US009089759B1

(12) United States Patent
Moschillo

(10) Patent No.: US 9,089,759 B1
(45) Date of Patent: Jul. 28, 2015

(54) GOLF ALIGNMENT AID

(71) Applicant: Daniel Moschillo, Hermitage, PA (US)

(72) Inventor: Daniel Moschillo, Hermitage, PA (US)

( * ) Notice: Subject to any disclaimer, the term of this patent is extended or adjusted under 35 U.S.C. 154(b) by 0 days.

(21) Appl. No.: 14/252,106

(22) Filed: Apr. 14, 2014

(51) Int. Cl.
*A63B 69/36* (2006.01)

(52) U.S. Cl.
CPC ..... *A63B 69/3667* (2013.01); *A63B 69/3623* (2013.01)

(58) Field of Classification Search
USPC ..... 473/218, 266, 270, 272, 273, 278, 409
See application file for complete search history.

(56) References Cited

U.S. PATENT DOCUMENTS

| | | | | |
|---|---|---|---|---|
| 5,014,994 | A * | 5/1991 | Peters | 473/218 |
| 5,171,017 | A * | 12/1992 | Betancourt | 473/218 |
| 5,616,085 | A * | 4/1997 | LaCoste et al. | 473/267 |
| 6,500,075 | B1 * | 12/2002 | McDevitt | 473/272 |
| 8,608,584 | B1 * | 12/2013 | Cobb | 473/218 |
| 2004/0185954 | A1 * | 9/2004 | Kallage, Jr. | 473/218 |
| 2009/0305804 | A1 * | 12/2009 | Kramski | 473/218 |
| 2013/0102406 | A1 * | 4/2013 | Yu et al. | 473/278 |

* cited by examiner

*Primary Examiner* — Nini Legesse
(74) *Attorney, Agent, or Firm* — Thomas/Horstemeyer, LLP

(57) ABSTRACT

Disclosed are various embodiments of systems and methods related to a golf alignment aid that focuses on providing repeatable ball positions for creating a more consistent, predictable, and solid golf shot. The golf alignment aid may comprise a planar element comprising a grid and a set of telescopic arms moveably attached to the planar element. The set of telescopic arms are configured to extend outwardly from the planar element along the longitudinal axis of the planar element.

20 Claims, 6 Drawing Sheets

36

| | |
|---|---|
| | Grid Coordinates: |
| | |
| | Stance: L- 2.5 R- 3 Grid Coordinates: |
| | Position Markers: Extend L- 3 and R – 2.5 |
| | Irons: Woods: |
| | 3- L(1,C) Driver- R(1,C) |
| | 4- L(½, C) 3-Wood – R(2,C) |
| | 5- L(2, B) |
| | 6- (0,B) |
| | 7- R(1,A) |
| | 8- (0,A) |
| | 9- R(2, A) |
| | |
| | |
| | |
| | |
| | |
| | |
| | |
| | |
| | |
| | |

FIG. 5

GOLF ALIGNMENT AID

BACKGROUND

Accuracy and consistency are two important factors in the game of golf. Golf swings frequently compensate from inconsistent and/or incorrect ball positions causing alterations in swing planes that produce poor contact with the ground and/or ball. Alignment and set-up are the foundation to a more balanced and fundamental swing for providing an accurate and consistent round of golf.

SUMMARY

Included are apparatuses and methods for creating more consistent, predictable and solid golf shots. One embodiment of an apparatus, among others, includes a golf alignment aid for determining a repeatable ball position for consistent golf swings, the golf alignment aid comprising a rectangular planar element having a grid; and a telescopic arm moveably attached to the rectangular planar element, the telescopic arm configured to extend outwardly from the planar element relative to the longitudinal axis of the planar element, and move horizontally along a track on the planar element.

Another embodiment of an apparatus, among others, includes a golf alignment aid comprising a planar element having a grid; and a set of telescopic arms slidably attached to the planar element, the set of telescopic arms being configured to extend outwardly from the planar element along the longitudinal axis of the planar element.

Also included is at least one embodiment of a method comprising positioning a golf alignment aid on a substantially level surface, the golf alignment aid comprising a grid and a set of telescopic arms; aligning the set of telescopic arms with a stance of a golfer; and determining a repeatable ball position on the golf grid for hitting a ball with a golf club based at least in part on a location of a ball on the golf grid.

Other embodiments, systems, methods, features, and advantages of this disclosure will be or become apparent to one with skill in the art upon examination of the following drawings and detailed description. It is intended that all such additional apparatuses, methods, features, and advantages be included within this description and be within the scope of the present disclosure.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

FIG. 5 is a drawing of a record log for recording coordinates of the golf alignment aid of FIG. 1 according to various embodiments of the present disclosure.

DETAILED DESCRIPTION

In the following discussion, a general description of apparatuses and methods according to various embodiments of the present disclosure is provided, followed by a discussion of the operation of the same. Embodiments of the present disclosure relate to a golf alignment aid. More specifically, disclosed herein are novel approaches to the implementation of a golf alignment aid that focuses on providing repeatable ball positions for a golfer to create more consistent, predictable, and solid golf shots.

The proximity of the ball position to the golfer may affect a golf shot. For example, ball positions that are too close to a golfer's feet typically create a steeper swing plane that result in a fade. Ball positions that are too far away from a golfer may create a flatter swing plan as the golfer reaches to make contact. Further, the ball position between a golfer's stance may also affect a golf shot. For example, ball positions that are closer to the golfer's front foot may result in higher ball flights while ball positions closer to the golfer's back foot may produce a lower ball flight. Accordingly, a combination of the ball position between a golfer's stance and the ball position distance extended from the front of a golfer's feet may produce an optimum ball placement for a consistent, natural, balanced, and solid golf shot. In addition, the ball position may vary based on the type of club used by the golfer for a particular shot.

The golf alignment aid, disclosed herein, may aid a golfer in finding and repeating a unique ball position for each club without drastically changing his or her typical golf swing. By finding a location on a grid for a ball position for each club that results in a solid, consistent, and comfortable golf shot, a golfer may record the respective coordinates of the grid for future use. Once a grid location is determined, the golfer may easily and effectively practice hitting the shot at the optimal position at the range or at home. Once the golfer is comfortable with the position of the ball on the grid following repetitive shots, the golfer may be able to practice the same shot without the grid by visualizing the correct ball position relative to his or her stance.

Figure 1:
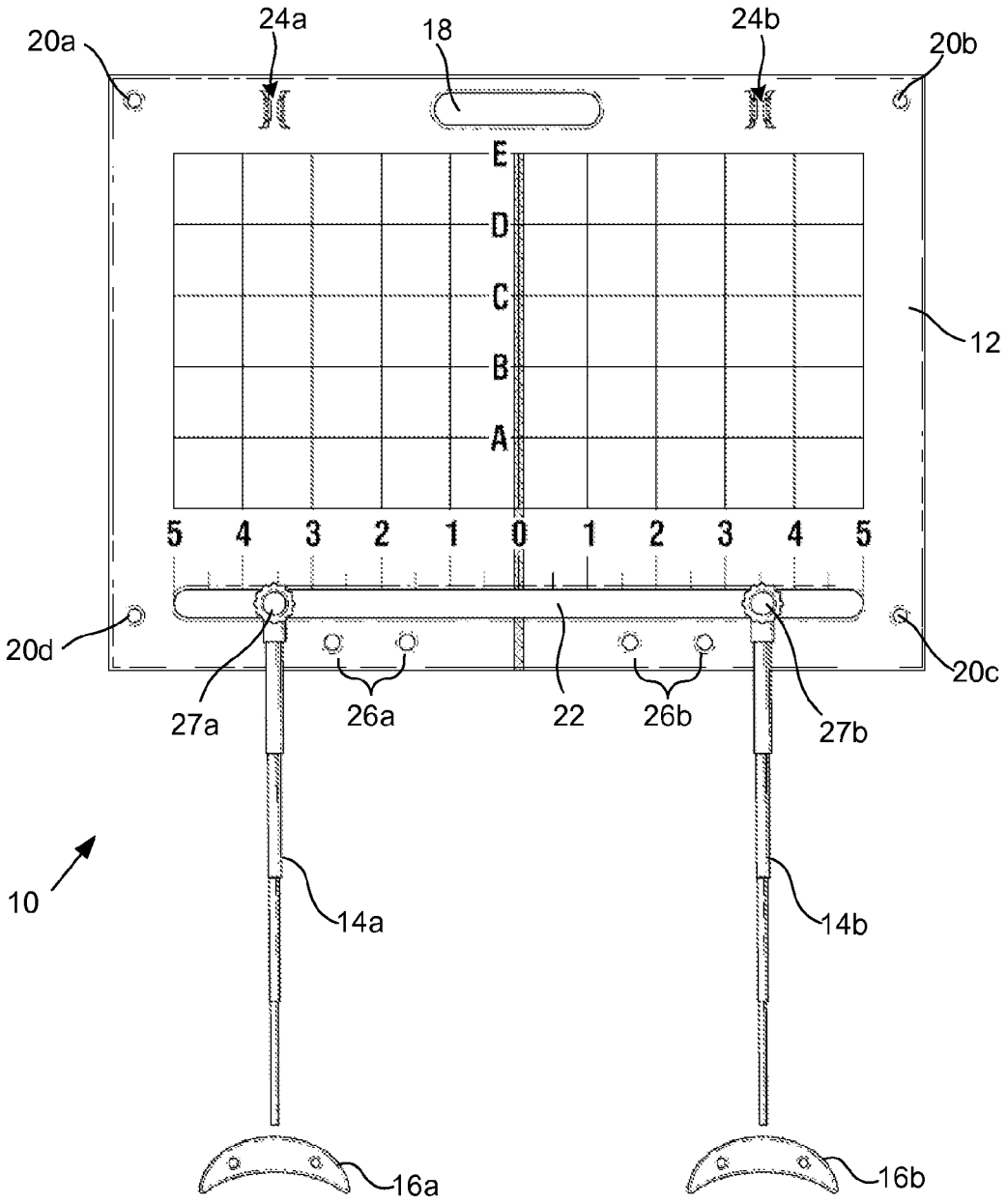
FIG. 1 is a drawing of a golf alignment aid in an in-use configuration according to various embodiments of the present disclosure.

Referring now to FIG. 1, shown is a drawing of an example of a golf alignment aid 10 in an in-use configuration according to various embodiments of the present disclosure. As depicted in FIG. 1, the golf alignment aid 10 may comprise a golf grid 12, one or more telescopic arms 14*a*, 14*b* (hereinafter "14") and foot markers 16*a*, 16*b* (hereinafter "16"). The golf grid 12 comprises a planar element labeled with intersecting grid lines to represent graph coordinates for repeatable ball placement. While the golf grid 12, as illustrated in FIG. 1, is rectangular in shape, it should be noted that the golf grid 12 may be square, triangular, circular, pentagonal, and/or any other appropriate type of shape. The golf grid 12 may comprise a durable plastic material such as, for example, polycarbonate plastic or other suitable material.

The intersecting grid lines may comprise horizontal and vertical lines. In FIG. 1, the grid lines along the vertical axis are labeled A, B, C, D, and E. The grid lines along the horizontal axis are labeled 0, 1, 2, 3, 4, and 5 on both the left and right sides of a center and neutral line. Although the grid lines are labeled A-E and 0-5, the grid lines may have more or less lines corresponding to the respective axis, and may be labeled differently. For example, both sets of grid lines may be labeled exclusively with letters or exclusively with numbers. The labeling of the grid lines in FIG. 1 is suitable for both left and right-handed golfers. However, other embodiments may comprise labeling that is consistent for only left-handed or right handed golfers. In some embodiments, the iterations between the grid lines of the grid may be substantially equivalent to a size of a golf ball. Accordingly, a golf ball may be positioned at the intersecting points of the grid lines and/or at the spaces in between the grid lines.

The golf grid 12 may further comprise a handle 18, one or more securing apertures 20*a*, 20*b*, 20*c*, 20*d* (hereinafter "20"), a sliding track 22, one or more storage latches 24*a*, 24*b* (hereinafter "24"), and/or one or more foot marker attaching components 26*a*, 26*b* (hereinafter "26"). The handle 18 may comprise an aperture about the golf grid 12 and/or device attached to the golf grid that is suitable for grasping and being held by a person's hand. The one or more securing apertures 20 comprise a hole within the golf grid 12 that is suitable for inserting a securing mechanism 34 (FIG. 4), such as, for example, a golf tee or other mechanism that can secure the golf grid 12 to the ground or other suitable surface via the one or more securing apertures 20. Although the golf grid 12 illustrates a securing aperture 20 at each of the corners of the golf grid 12, some embodiments may not include a securing aperture 20. In other embodiments, the golf grid 12 may comprise more or less securing apertures 20 than those shown in FIG. 1. In addition, the securing apertures 20 may be located at any suitable location on the golf grid 12 that would not interfere with the use of the grid on the golf grid 12. For example, the golf grid 12 may comprise two securing apertures 20 which may be located on two sides or a single side of the golf grid 12.

The sliding track 22 may be positioned along the horizontal axis of the golf grid 12 near the bottom side of the golf grid 12. The telescopic arms 14 may be slidably attached to the sliding track 22 via connectors 27*a*, 27*b* (hereinafter 27). The sliding track 22 is configured such that the telescopic arms 14 may be positioned and subsequently secured along the sliding track 22 at various locations along the horizontal axis to match the width of the golfer's stance. The sliding track 22 may comprise an aperture in the golf grid 12 extending about horizontal axis of the golf grid 12, a track for guiding the telescopic arms 14 along the golf grid 12, and/or any other suitable component for sliding the telescopic arms 14 about the golf grid 12 for appropriate positioning.

The golf grid 12 may comprise unit markings to denote the horizontal position of the telescopic arms 14. The unit markings for the sliding track 22 may correspond to the grid on the golf grid 12 as illustrated in FIG. 1, or may comprise units that are not related to the grid. For example, the golf grid 12 of FIG. 1 illustrates unit markings corresponding to the units and half-units of the grid lines corresponding to the 0-5 for both the left and right portions of the grid. As shown in FIG. 1, the first telescopic arm 14*a* is positioned about the sliding track 22 at the 3.5 marker on the left portion of the golf grid 12, and the second telescopic arm 14*b* is positioned about the sliding track 22 at the 3.5 marker on the right portion of the golf grid 12.

Figure 2:
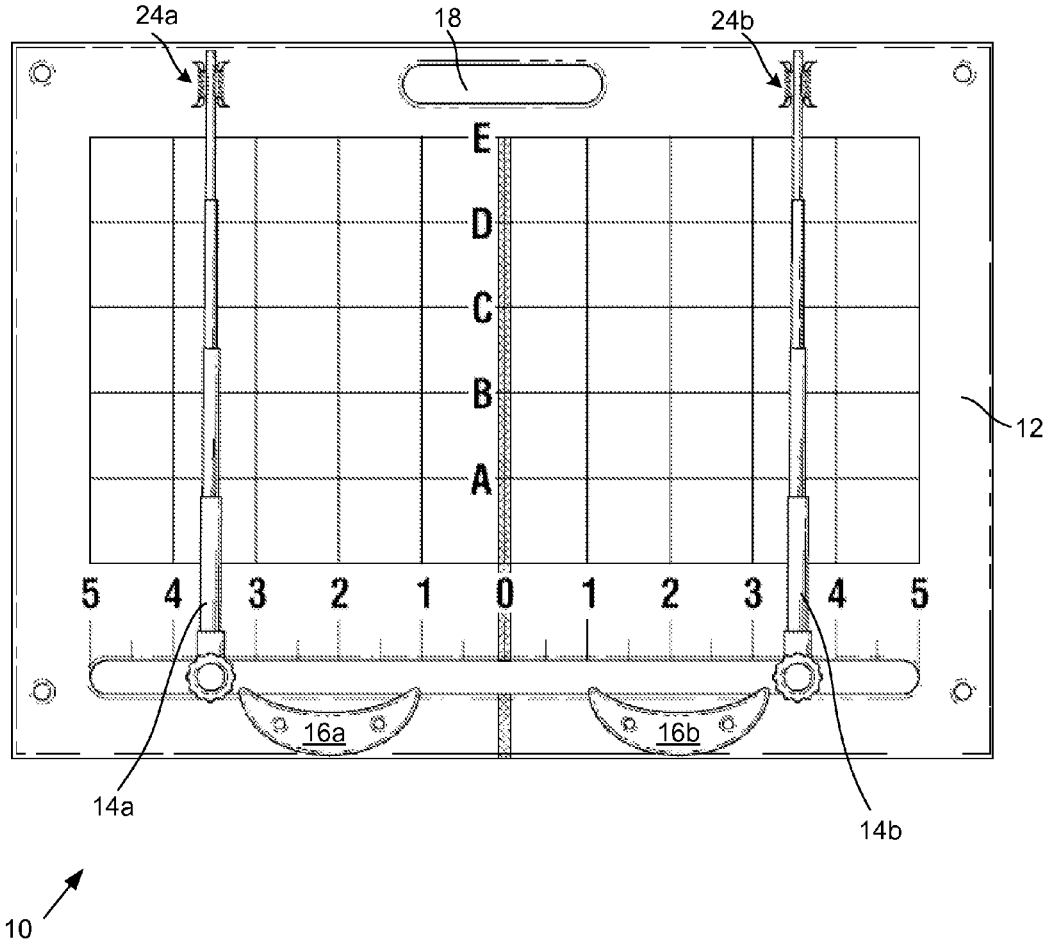
FIG. 2 is a drawing of the golf alignment aid of FIG. 1 in the stored configuration according to various embodiments of the present disclosure.

The one or more storage latches 24*a*, 24*b* (hereinafter "24") comprise latches and/or other securing components used to secure the telescopic arms 14 to the golf grid 12 when the telescopic arms 14 are in the storage position. The one or more foot marker attaching components 26 may comprise a set of apertures or flanges that may be used to attach and/or snap the foot markers 16 to the golf grid 12 when the golf alignment aid 10 is in the stored configuration (FIG. 2). In some embodiments, the golf alignment aid 10 may not comprise the one or more foot markers 16. As such, the golf grid 12 may not comprise the one or more foot marker attaching components 26.

The telescopic arms 14 are slidably attached to the sliding track 22 of the golf grid 12 via connectors 27. The connectors 27 may be knobs, screws, and/or other type of connector that permits the telescopic arms 14 to slide along the sliding track 22 when loosened. The connectors 27 may also secure the telescopic arms 14 to a set position on the sliding track 22 when tightened. Accordingly, the connectors 27 may be used to move and secure the telescopic arms 14 to a set position that is substantially equivalent to a stance of a golfer. In some embodiments, the telescopic arms 14 may attach to the sliding track 22 in a manner that allows the telescopic arms 14 to swivel around the longitudinal axis of the sliding track 22. As such, the telescopic arms 14 may be rotated around the longitudinal axis of the golf grid 12 to allow the telescopic arms 14 to extend across the golf grid 12 for storage (FIG. 2). As previously discussed, the telescopic arms 14 may be positioned along the sliding track 22 relative to a golfer's stance. For example, a 6'2" golfer may have a wider stance than a 5'2" golfer. Accordingly, the distance between the first telescopic arm 14*a* and the second telescopic arm 14*b* may be greater for a golfer having a wider stance than for a golfer having a narrower stance.

The telescopic arms 14 may be extended outwardly from the golf grid 12 relative to the longitudinal axis of the golf grid 12 during the in-use configuration. The telescopic arms 14 may be used as guides for denoting the distance between the golfer and the golf grid 12. In some embodiments, the telescopic arms 14 comprise unit markings to denote extension length of the telescopic arms 14. For example, the telescopic arms 14 may comprise unit markings corresponding to inch and half-inch markings. The telescopic arms 14 may be extended outwardly from the golf grid 12 to the front of a golfer's feet when the golfer is positioned in a golf stance relative to the golf grid 12. Each telescopic arm 14 may be extended to a corresponding position near the golfer's feet when the golfer is positioned comfortably relative to the golf grid 12 for executing a golf shot off of the golf grid 12. For example, the telescopic arms 14 may extend outwardly from the golf grid 12 when the golfer is at a neutral position of the golf grid 12. In some embodiments, the neutral position may be denoted by the (0, 0) coordinate of the golf grid 12. In some embodiments, the golf alignment aid 10 may comprise a single telescopic arm 14 which may be used as a center marker for a golfer's stance.

The foot markers 16 may be used to mark the position of the golfer's feet when the golfer is in a golf stance relative to the golf grid 12. The foot markers 16 may contain apertures for inserting a securing mechanism used to secure the foot markers 16 to the ground and/or other appropriate surface. The securing mechanism may comprise a golf tee, a spike, and/or other mechanism that may be used to secure the foot markers 16 to the ground and/or other appropriate surface. In addition, the apertures may also be used to secure the foot markers 16 to the golf grid 12 for storage via the foot marker attachment components 26. In some embodiments, the golfer may determine the location of the foot markers 16 via the telescopic arms 14 and secure the foot markers 16 at the appropriate location. Once the foot markers 16 are secured, the telescopic arms 14 may be retracted since the secured foot markers 16 denote the position of the golfer's feet relative to the golf grid 12. In some embodiments, the golf alignment aid 10 may not comprise foot markers 16. Accordingly, the golfer may position his or her feet at the extended end of the telescopic arms 14.

Moving on to FIG. 2, shown is a drawing of an example of a golf alignment aid 10 in a storage configuration according to various embodiments of the present disclosure. The telescopic arms 15 are extended across the golf grid 12 and secured in place on the golf grid 12 via the securing latches 24. In some embodiments, the telescopic arms 14 may be fully retracted and may not need to be secured to the golf grid 12 via the securing latches 24. In addition, the foot markers 16 are shown to be secured to the foot marker attaching components 26 of the golf grid 12. The handle 18 on the golf grid 12 provides convenience for carrying the golf alignment aid 10. In some embodiments, the golf alignment aid 10 may be foldable. For example, the golf alignment aid 10 may be folded in half for compactness and may be stored in a golf bag and/or other appropriate location.

Figure 3:
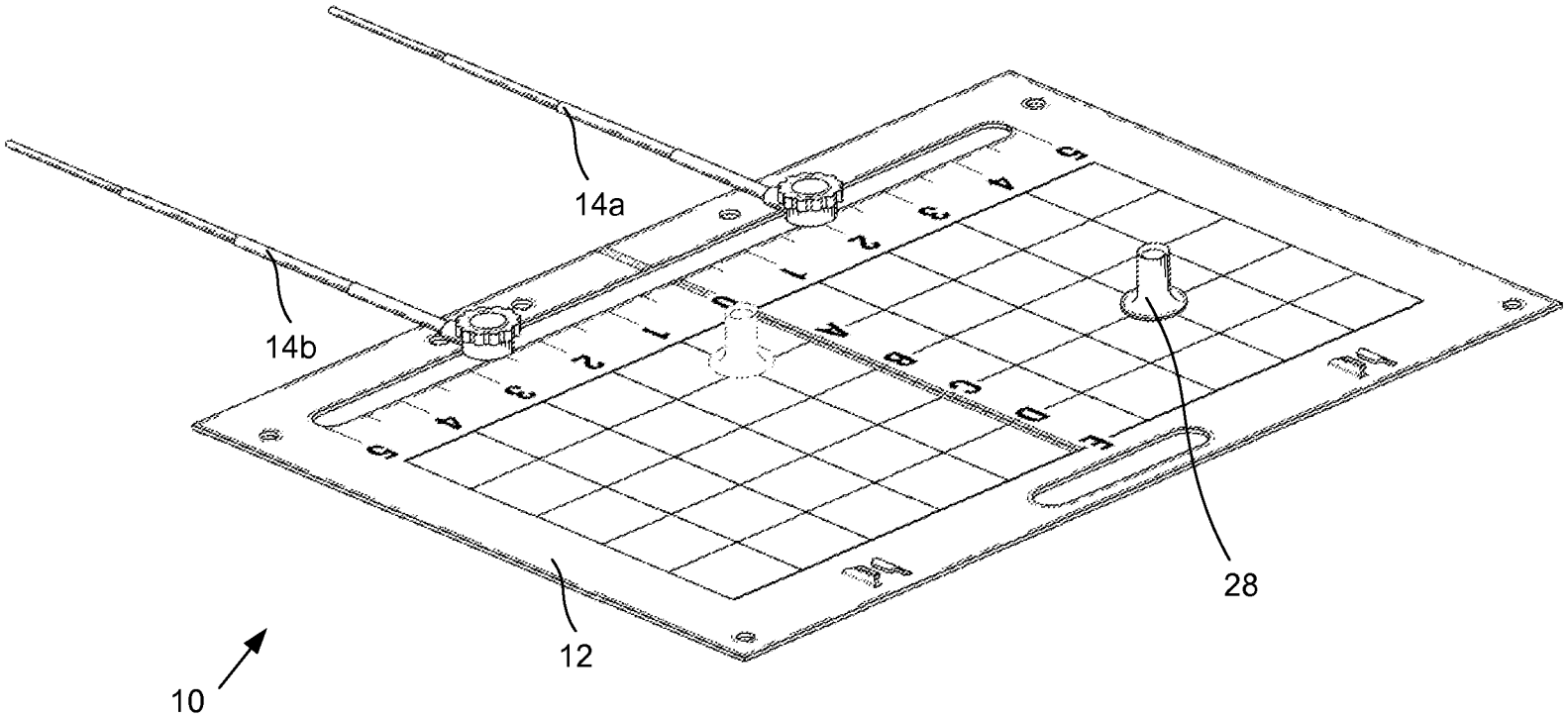
FIG. 3 is a drawing of a ball holder attached to the golf alignment aid of FIG. 1 according to various embodiments of the present disclosure.

Turning now to FIG. 3, shown is a drawing of an example of a ball holder 28 positioned on the golf alignment aid 10 in the in-use configuration according to various embodiments of the present disclosure. The ball holder 28 may be used for practicing shots that use a golf tee and/or prefer the ball to be positioned at an elevated height from the golf grid 12. In some embodiments, the ball holder 28 may comprise a hole at the top end of the ball holder 28 that extends towards a bottom end of the ball holder 28. Golf tees of varying heights may be inserted into the hole of the ball holder 28. In other embodiments, the ball holder 28 may be used to support a stationary golf ball without the use of the golf tee. Accordingly, the top end of the ball holder 28 may be concave and configured for holding a stationary ball. The bottom end of the ball holder 28 may comprise a suction cup used to secure the ball holder 28 to the golf grid 12. As shown in FIG. 3, the ball holder 28 may be positioned at different portions of the golf grid 12.

Figure 4:
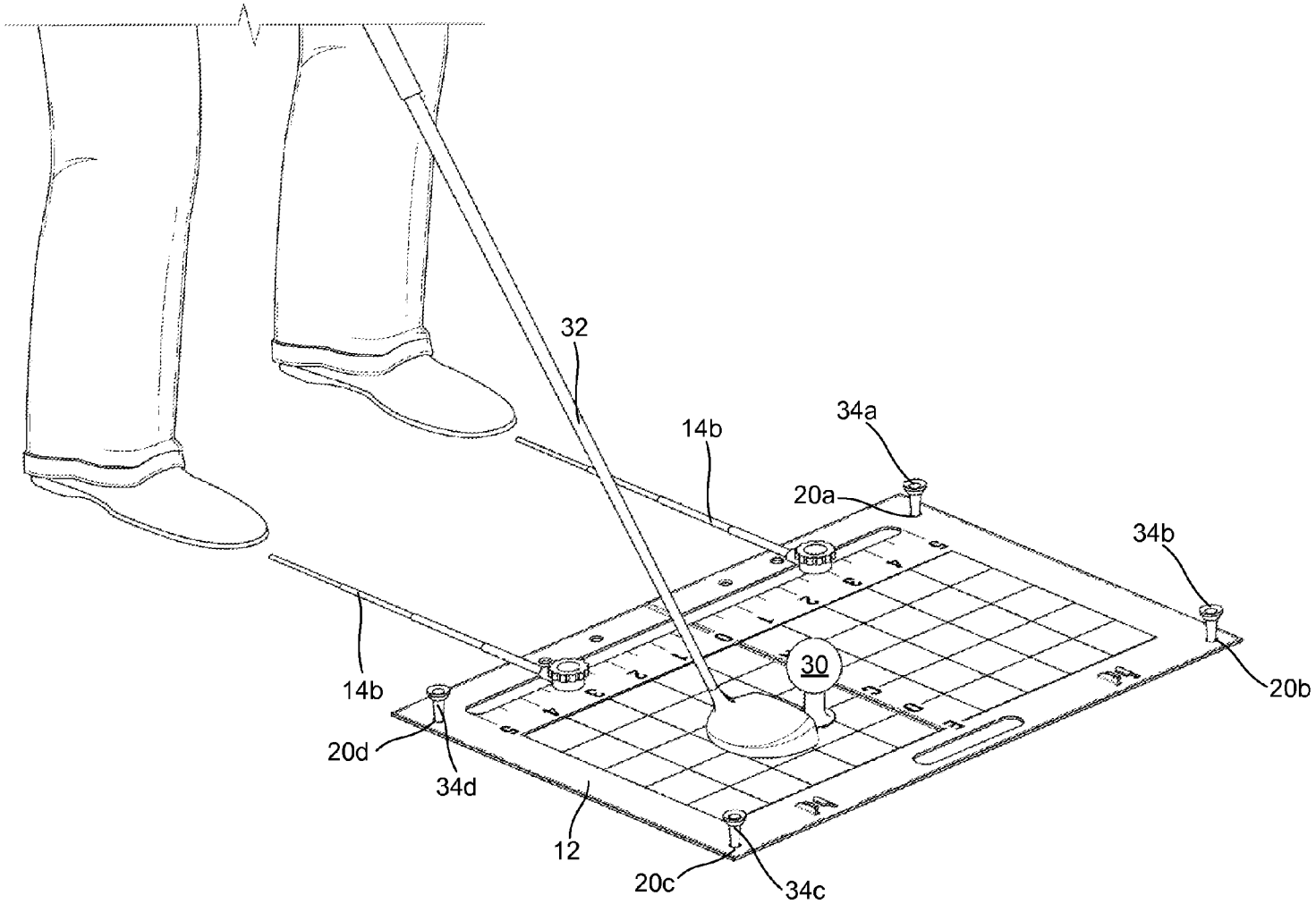
FIG. 4 is a drawing of a golfer positioned relative to the golf alignment aid of FIG. 1 according to various embodiments of the present disclosure.

Referring next to FIG. 4, shown is a drawing of an example of a golfer using the golf alignment aid 10 according to various embodiments of the present disclosure. As shown in FIG. 4, the golf alignment aid 10 is in the in-use configuration with the telescopic arms 14 positioned relative to the golfer's stance and extended outwardly from the golf grid 12 to the front of the golfer's feet. Although the foot markers 16 are not shown in FIG. 4, the foot markers 16 may be used and positioned near the location of the golfer's feet. The golf grid 12 is secured to the ground and/or other surface by securing mechanisms 34*a*, 34*b*, 34*c*, 34*d* (hereinafter "34"), such as, for example, golf tees, spikes, and/or other component that may be used to secure the golf grid 12 to the ground and/or other surface. In FIG. 4, the golfer has positioned a golf ball 30 on the ball holder 28 at a coordinate location R (1, C). Since the golf grid 12 is configured for both left and right-handed golfers, the letters corresponding to the vertical axis are near the center of the grid with the numbers 0-5 denoting the horizontal axis on both the left and right sides of the center of the grid. As such, the "R" in the coordinates of the example above corresponds to the right side of the grid relative to the golfer. The "C" coordinate denotes the location of the golf ball 30 on the vertical axis and the "1" denotes the location of the golf ball 30 on the horizontal axis. The golfer may execute a golf shot by hitting the golf ball 30 with the golf club 32, and evaluate whether the golf shot was solid, consistent, and comfortable to the golfer. The golfer may continue to hit a golf ball 30 at this position. If the golfer is comfortable with the golf shots at this particular coordinate, the golfer may mark the position on the golf grid 12 with the use of a marker, color, sticker, notation, and/or other type of marker. In some embodiments, the golfer may log the coordinate position, extension lengths of the telescopic arms 14, track position of the telescopic arms 14, and/or other desired notations associated with the golf alignment aid 10 for future reference.

Referring next to FIG. 5, shown is an example of a record log 36 that a golfer may use to denote desired coordinate positions and telescopic arm positions for future reference. Accordingly, once the golfer has determined an acceptable ball position, the golfer may refer to the record log 36 at a later time and align the golf alignment aid 10 (FIGS. 1-4) to the recorded positions prior to use. In addition, the golfer may place the golf ball 30 (FIG. 4) at the recorded position for the golf club 32 (FIG. 4) that the golfer will use for practicing.

Figure 6:
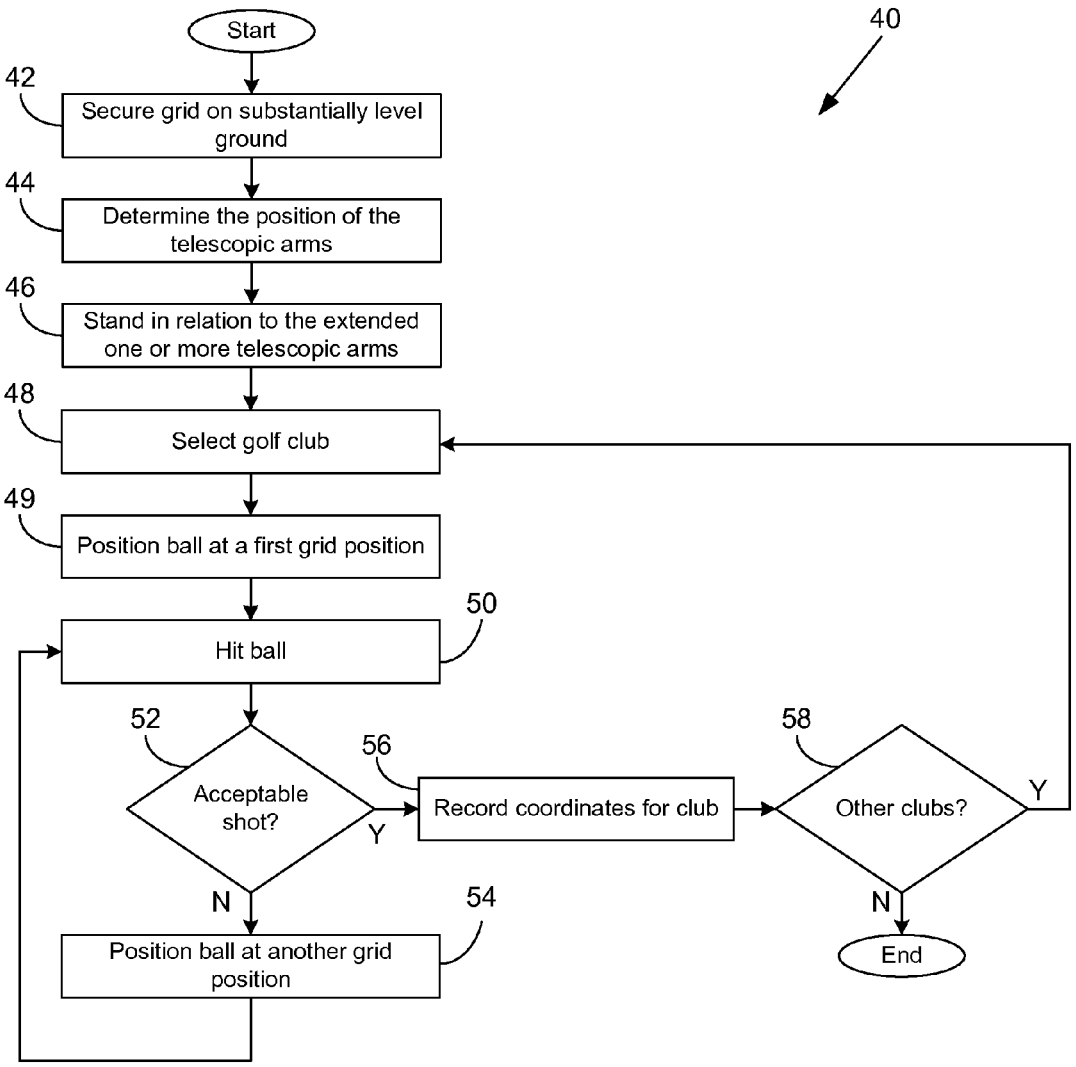
FIG. 6 is a flowchart illustrating methods according to various embodiments of the present disclosure.

Moving on to FIG. 6, shown is a flowchart 40 that provides one example of determining repeatable ball positions for one or more golf clubs 32 (FIG. 4) that are unique to a particular golfer. It is understood that the flowchart of FIG. 6 provides merely an example of the many different types of functional arrangements that may be employed to implement the operation of the methods as described herein.

At reference numeral 42 a golfer secures the golf alignment aid 10 (FIGS. 1-4) to substantially level ground so that a golf ball 30 (FIG. 4) may be placed on the golf grid 12 (FIGS. 1-4) without rolling off. The golf alignment aid 10 may be secured to the ground by inserting securing mechanisms 34 (FIG. 4) through the securing apertures 20 (FIGS. 1-4) of the golf grid 12. The securing apertures 20 may comprise golf tees, spikes, and/or any other type of component that can be inserted into the ground and/or other surface.

At reference numeral 44, the position of the telescopic arms 14 (FIGS. 1-4) is determined. If there are multiple telescopic arms 14, the golfer may slide the telescopic arms 14 along the sliding track 22 (FIG. 1) until the telescopic arms 14 are aligned with the golfer's feet when the golfer is positioned in a preferred stance relative to the golf grid 12. If there is only one telescopic arm 14, the golfer may slide the telescopic arm 14 such that it is in the center of the golfer's stance relative to the golf grid 12. Once the appropriate positions of the telescopic arms 14 on the sliding track 22 are determined, the telescopic arms 14 may be tightly secured to the sliding track 22 via the connectors 27(FIG. 1) to avoid further movement along the sliding track 22 during use of the golf alignment aid 10. In addition to determining a set location of the telescopic arms 14 on the sliding track 22, the telescopic arms 14 may extend outwardly from the golf grid 12 to the front of the golfer's feet when the golfer is positioned in a preferred stance relative to the golf grid 12. This position may be determined based on the distance from the golf grid 12 to the golfer's feet when a golf club held by the golfer rests at the neutral position (0, 0) of the grid. If foot markers 16 (FIG. 1) are used, the foot markers 16 may be placed at the extended end of each of the telescopic arms 14. The foot markers 16 may be secured to the ground and/or other surface. The position of the telescopic arm 14 and the foot markers 16 may be used mark a foot position and stance which are consistent and repeatable.

At reference numeral 46, the golfer may position himself or herself relative to the golf alignment aid 10 such that a first foot is positioned at the end of a first telescopic arm 14*a* and a second foot is placed at the end of the second telescopic arm 14*b*. At reference numeral 48, the golfer may select a golf club 32 (FIG. 4). Since ball positions may vary for different golf clubs 32, the golfer may want to determine an optimal grid spot for different golf clubs 32.

At reference numeral 49, the golfer places the golf ball 30 (FIG. 4) at a first grid position on the golf grid 12. The first grid position may be on a corner of a grid (e.g., L(5, 0)), the neutral position (0,0), or any other location on the grid. At reference numeral 50, the golfer hits the golf ball 30 with the selected golf club 32. At reference numeral 52, the golfer determines if the golf shot was acceptable. An acceptable shot is a shot that the golfer determines to be solid, consistent, and/or comfortable. For example, a golfer may determine that a golf shot is acceptable if his or her comfort level with respect to the golf swing is high (e.g., 9 out of 10) and the golf ball 30 lands in an anticipated area. In some embodiments, the golfer may hit more than one golf ball 30 at the same ball position on the golf grid 12 to evaluate whether golf shots of balls at the same ball position are acceptable. At reference numeral 54, if the ball position is determined to not be acceptable, the golfer may position the golf ball 30 at another grid position. For example, if the first grid position was at coordinate L (1, A), the golfer may reposition the golf ball 30 or other golf ball 30 at coordinate L (1, B). The golfer will then hit the golf ball 30 to evaluate whether the new grid position of the golf ball 30 is acceptable to the golfer. The golfer may continue to place the golf ball 30 along the grid at different locations until the golfer finds an acceptable ball position for the selected golf club 32. At reference numeral 56, the golfer may record the coordinates of the ball position. In some embodiments, the golfer may use a marker such as a sticker, color, notation, and/or other type of marker on the grid to denote the preferred ball position for a respective club 32. In other embodiments, the golfer may record the coordinates of the ball position prior to being hit. At reference numeral 58, it is determined whether a ball position for another golf club is to be determined.

Once the grid spot for each golf club is determined, a golfer may easily and effectively practice at the range or at home. The golf alignment aid 10 may also be used to determine ball positions for different ball flights, such as trajectories and curves. When a golfer can effectively take repeatable practice from the range to the golf course, the result is a more solid and consistent round of golf.

Although the flowchart of FIG. 6 shows a specific order of execution, it is understood that the order of execution may differ from that which is depicted. For example, the order of execution of two or more steps may be scrambled relative to the order shown. Also, two or more steps shown in succession in FIG. 6 may be executed concurrently or with partial concurrence. Further, in some embodiments, one or more of the blocks shown in FIG. 6 may be skipped or omitted. It is understood that all such variations are within the scope of the present disclosure.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A golf alignment aid for determining a repeatable ball position for consistent golf swings, the golf alignment aid comprising:

a rectangular planar element having a grid and a plurality of securing apertures for securing the rectangular planar element to a surface, wherein the plurality of securing apertures each comprise a hole within the grid and are configured for inserting a securing mechanism;

a telescopic arm moveably attached to the rectangular planar element, the telescopic arm configured to:

extend outwardly from the planar element relative to a longitudinal axis of the planar element, and move horizontally along a track on the planar element; and a ball holder configured to be detachably attached to the grid of the planar element.

2. The golf alignment aid of claim 1, wherein the telescopic arm is moveably attached to the track of the planar element via a connector.

3. The golf alignment aid of claim 2, wherein the telescopic arm is secured to a secured location on the track when the connector is tightened and wherein the telescopic arm is moveable horizontally along the track when the connector is loosened.

4. The golf alignment aid of claim 1, wherein the planar element further comprises a handle.

5. The golf alignment aid of claim 1, wherein the planar element further comprises a storage latch for securing a portion of the telescopic arm to the planar element for storage.

6. The golf alignment aid of claim 1, wherein increments of the grid are substantially equivalent to a size of a golf ball.

7. The golf alignment aid of claim 1, wherein the securing mechanism comprises a golf tee.

8. The golf alignment aid of claim 1, wherein the ball holder comprises a hole at a top end of the ball holder that extends towards a bottom end of the ball holder, and wherein the bottom end of the ball holder further comprises a suction cup used to secure the ball holder to the golf grid.

9. A golf alignment aid comprising:

a planar element having a grid and a plurality of securing apertures for securing the planar element to a surface, wherein the plurality of securing apertures each comprise a hole within the grid and are configured for inserting a securing mechanism;

a set of telescopic arms slidably attached to the planar element, the set of telescopic arms being configured to extend outwardly from the planar element along a longitudinal axis of the planar element; and a ball holder configured to be detachably attached to the grid of the planar element.

10. The golf alignment aid of claim 9 further comprising a sliding track coupled to the planar element, wherein the set of telescopic arms are slidably attached to the sliding track and configured to slide horizontally along the sliding track.

11. The golf alignment aid of claim 9, wherein increments of the grid are substantially equivalent to a size of a golf ball.

12. A method, comprising:

positioning a golf alignment aid on a substantially level surface, the golf alignment aid comprising a grid, a set of telescopic arms, a plurality of securing apertures, and a ball holder;

securing the golf alignment aid to the substantially level surface;

positioning the ball holder on the grid;

aligning the set of telescopic arms with a stance of a golfer; and determining a repeatable ball position on the grid for hitting a ball with a golf club based at least in part on a location of the ball on the grid.

13. The method of claim 12, wherein determining a repeatable ball position on the grid further comprises:

placing the ball on a coordinate of the grid;

executing a golf shot by hitting the ball off the grid; and evaluating whether the golf shot is acceptable based at least in part on a comfort level of the golfer.

14. The method of claim 13, further comprising recording the coordinate on the grid when the golf shot is acceptable.

15. The method of claim 13, further comprising executing another golf shot by hitting another ball off the grid when the golf shot is not acceptable, wherein the other ball is placed on another coordinate on the grid.

16. The method of claim 12, further comprising holding the golf club at a neutral position of the grid to determine a standing distance between the grid and the golfer.

17. The method of claim 12, further comprising extending the set of telescopic arms outwardly from the grid based at least in part on a standing distance between the grid and the golfer.

18. The method of claim 17, further comprising recording an extension position for the set of telescopic arms when the set of telescopic arms have been extended to the standing distance, wherein the set of telescopic arms comprise unit markings.

19. The method of claim 12, wherein aligning the set of telescopic arms further comprises sliding the set of telescopic arms along a track on the grid such that a distance between the set of telescopic arms is substantially equivalent to a distance between a first foot of the golfer and a second foot of the golfer.

20. The method of claim 12, wherein securing the golf alignment aid to the substantially level surface comprises inserting a securing mechanism configured to secure the golf grid to the ground or other suitable surface through at least one of the plurality of securing apertures.

* * * * *